US005310052A

United States Patent [19]

Bindman

[11] Patent Number: 5,310,052

[45] Date of Patent: May 10, 1994

[54] SHOWER CURTAIN RING PACKAGE

[75] Inventor: Stanley Bindman, Roslyn Heights, N.Y.

[73] Assignee: Creative Bath Products, Inc., Islip, N.Y.

[21] Appl. No.: 58,311

[22] Filed: Jun. 29, 1993

[51] Int. Cl.[5] ..... A44B 21/00

[52] U.S. Cl. ..... 206/304.1; 206/348; 206/497; 206/509; 206/821

[58] Field of Search ..... 206/576, 303, 304.1, 206/304.2, 338, 340, 348, 497, 503, 505, 506, 508, 509, 821

[56] References Cited

U.S. PATENT DOCUMENTS

| | | | |
|---|---|---|---|
| 3,585,775 | 6/1971 | Stenniken | 206/497 X |
| 3,955,673 | 5/1976 | Fosness | 206/303 X |
| 4,374,563 | 2/1983 | Alexander | 206/497 X |
| 4,491,222 | 1/1985 | Gaccetta et al. | 206/497 X |
| 4,955,471 | 9/1990 | Hirose et al. | 206/303 |

*Primary Examiner*—Paul T. Sewell
*Assistant Examiner*—Jacob K. Ackun, Jr.
*Attorney, Agent, or Firm*—Schweitzer Cornman & Gross

[57] ABSTRACT

A unitary totally transparent package of shower curtain rings comprising: a stack of ring-like articles, each of which articles has at least one predetermined discontinuity therein, said discontinuities being aligned one with the other in a manner whereby each of the articles in the stack is congruently aligned with the other; a cylindrical transparent PVC cap element disposed tightly over the uppermost ring-like article in intimate contact therewith; an elongated tubular transparent polyvinyl chloride plastic sleeve enveloping the stack of rings from top to bottom and being shrunken into intimate contact with the outer surfaces of each of said rings and said cap to provide a package having a corrugated appearance and providing visual access to the inner and outer portions of said entire stack of rings.

2 Claims, 4 Drawing Sheets

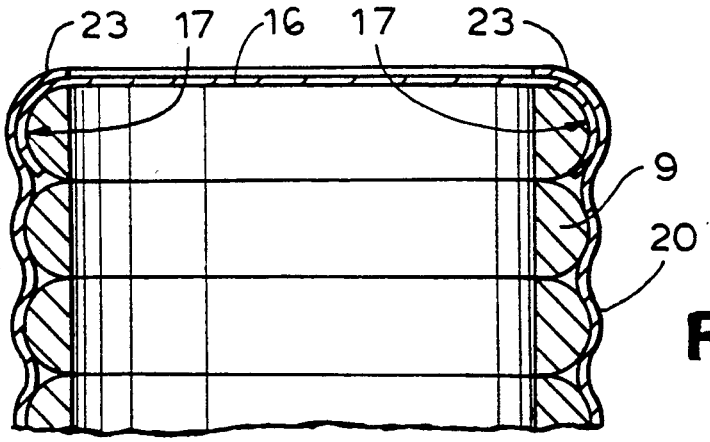
FIG. 6
FIG. 7
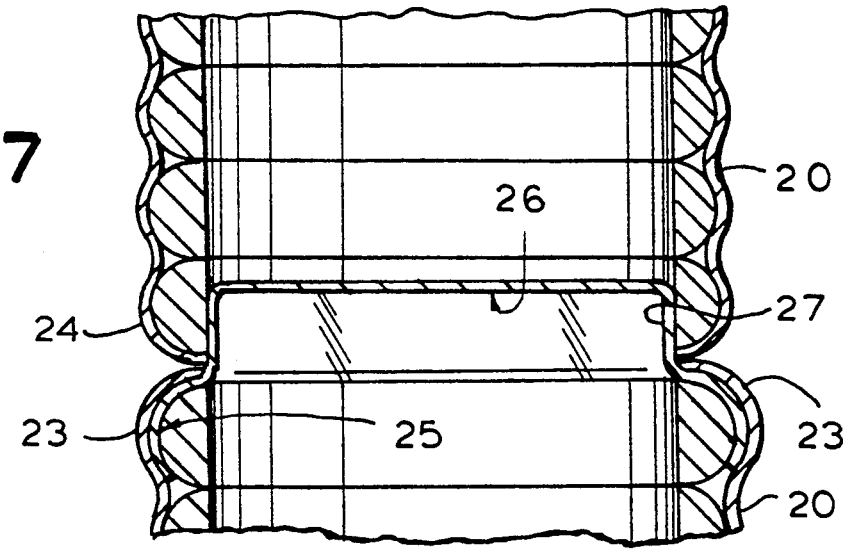
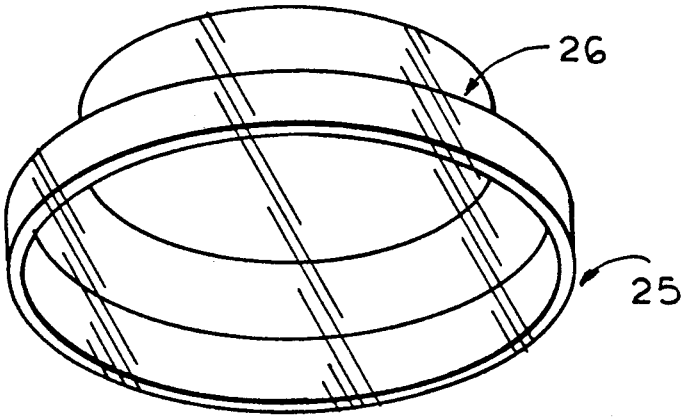
FIG. 8

SHOWER CURTAIN RING PACKAGE

FIELD OF THE INVENTION

The present invention is directed to a new and improved package, particularly useful for packaging shower curtain rings in multiples of 6–12 or more.

Background of the Invention

Numerous packaging methods and devices employing shrink wrap plastic film have been described in the literature. U.S. Pat. Nos. 4,304,332; 3,255,877; and 3,746,395, are exemplary and illustrate a plurality of cylindrical cans held in units of four or six, by means of shrink wrap plastic, with the cans arranged in either end to end or side by side relationship.

U.S. Pat. No. 4,940,141 describes a package for cans of soft drinks, beer and the like. The package comprises a single long sleeve of shrink wrap plastic film within which the cans are stacked. U.S. Pat. No. 3,858,380 illustrates a coin wrapping apparatus.

These references are not directed to a packaging container for rings, particularly shower curtain rings, nor do these disclose or describe methods for packaging shower curtain rings. Such rings are typically stacked and sold in windowed folded paperboard cartons, an expensive and time consuming packaging operation.

SUMMARY OF THE INVENTION

The present invention is directed to a new and improved package assembly for a plurality of shower curtain rings and the method of making the package. The rings are all aligned congruently on a mandrel with their closures juxtaposed. They are overwrapped with a heat-shrinkable PVC sleeve and a special PVC cap to establish an attractive and compact unit. This method lends itself to total automation by utilization of available materials handling and robotics technology. For a better appreciation of the invention and its attendant advantages, reference should be made to the following detailed description taken in conjunction with the accompanying drawings.

DESCRIPTION OF THE DRAWINGS

FIG. 6 is a cross-sectional view showing the top closure;

FIG. 7 is a cross-sectional view showing a bottom closure adapted for stacking; and FIG. 8 is a perspective view of the alternate top closure element.

DESCRIPTION OF THE PREFERRED EMBODIMENT

Figure 2:
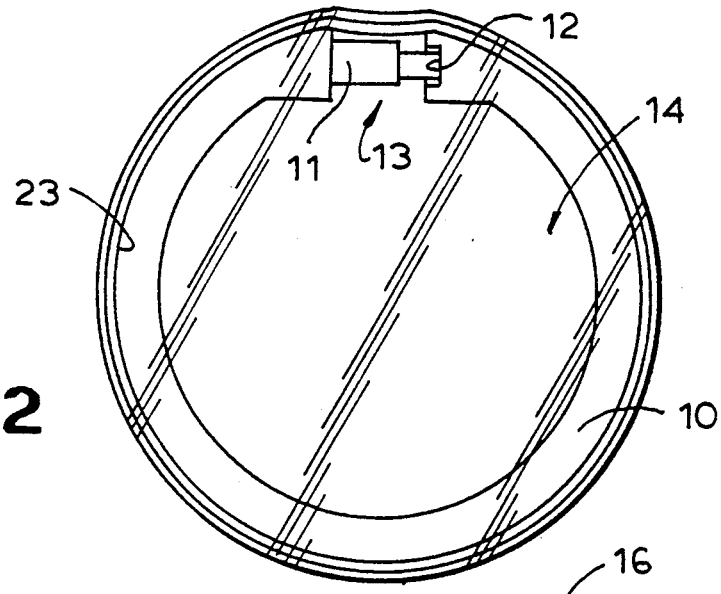
FIG. 2 is a top plan view of the embodiment of FIG. 1.
Figure 1:
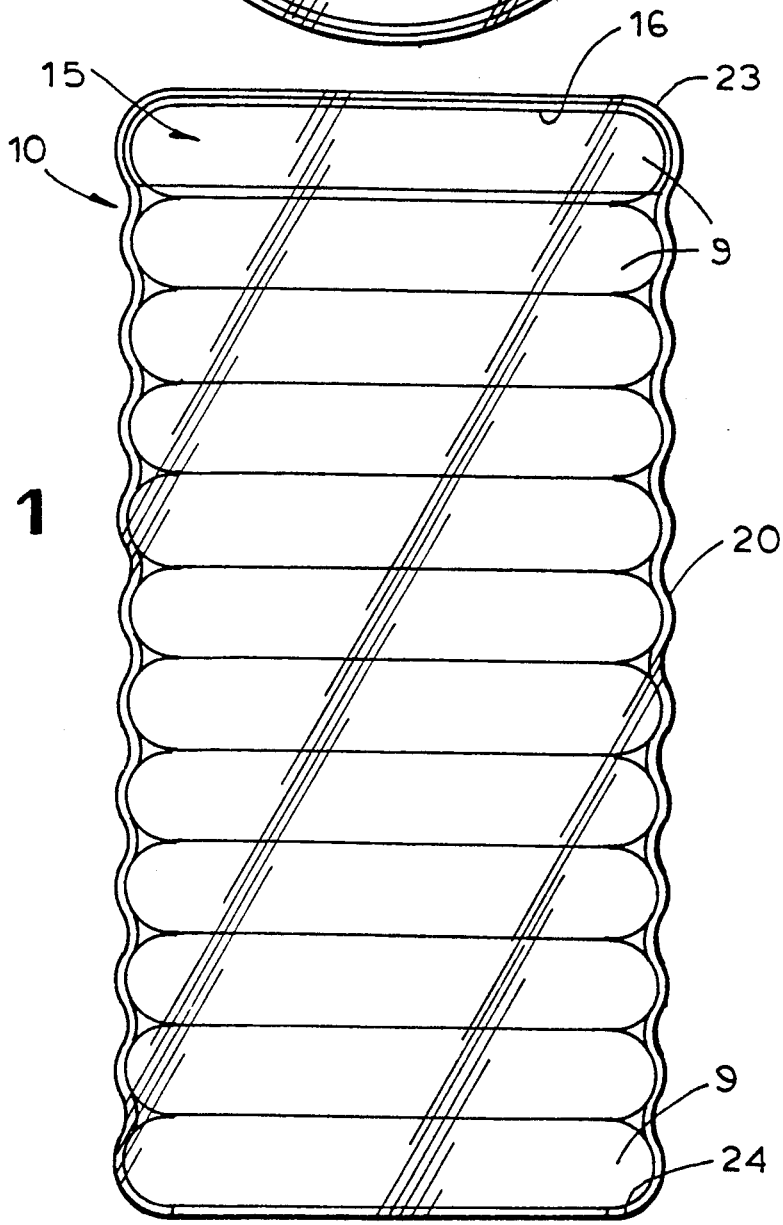
FIG. 1 is a front elevational view of a package according to the present invention with shower curtain rings aligned and stacked therein.
Figure 3:
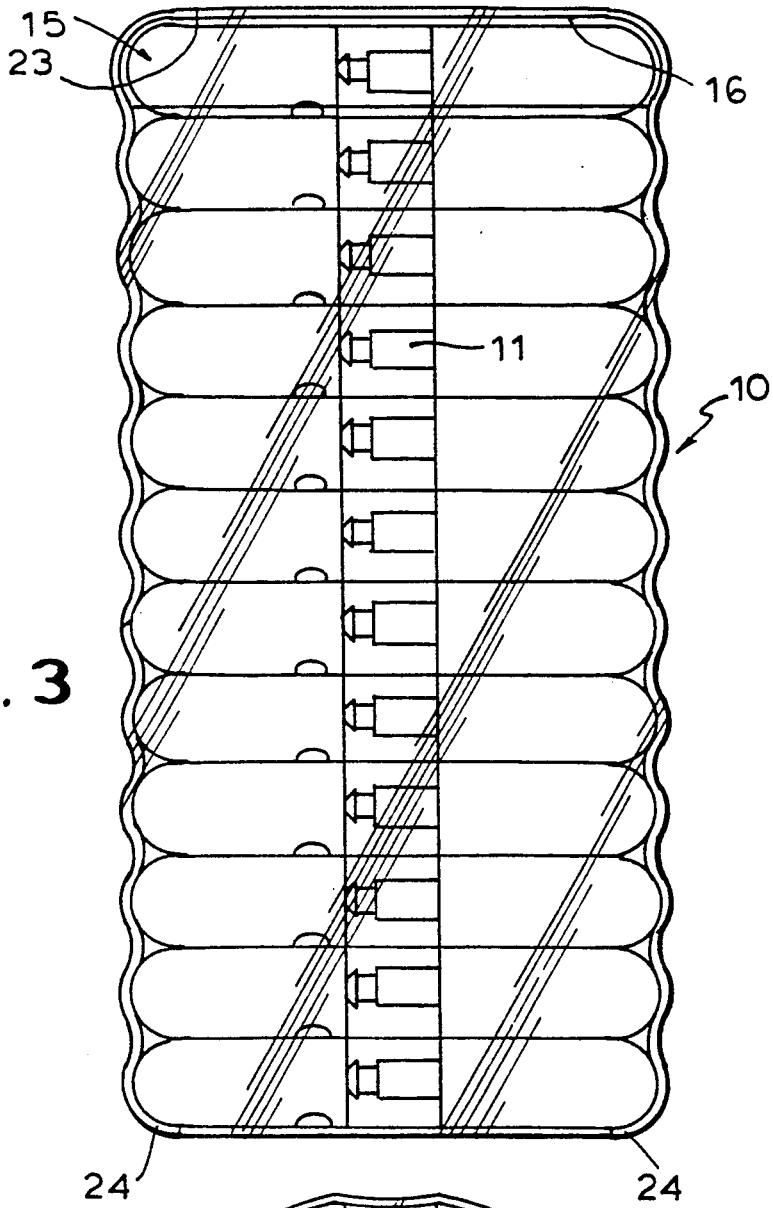
FIG. 3 is a rear elevational view of the package of FIG. 1.
Figure 4:
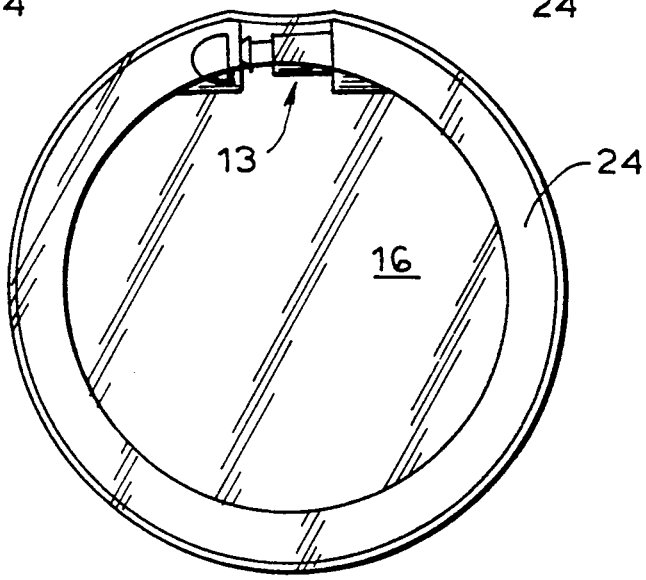
FIG. 4 is a bottom plan view of the package of FIG. 1.
Figure 5:
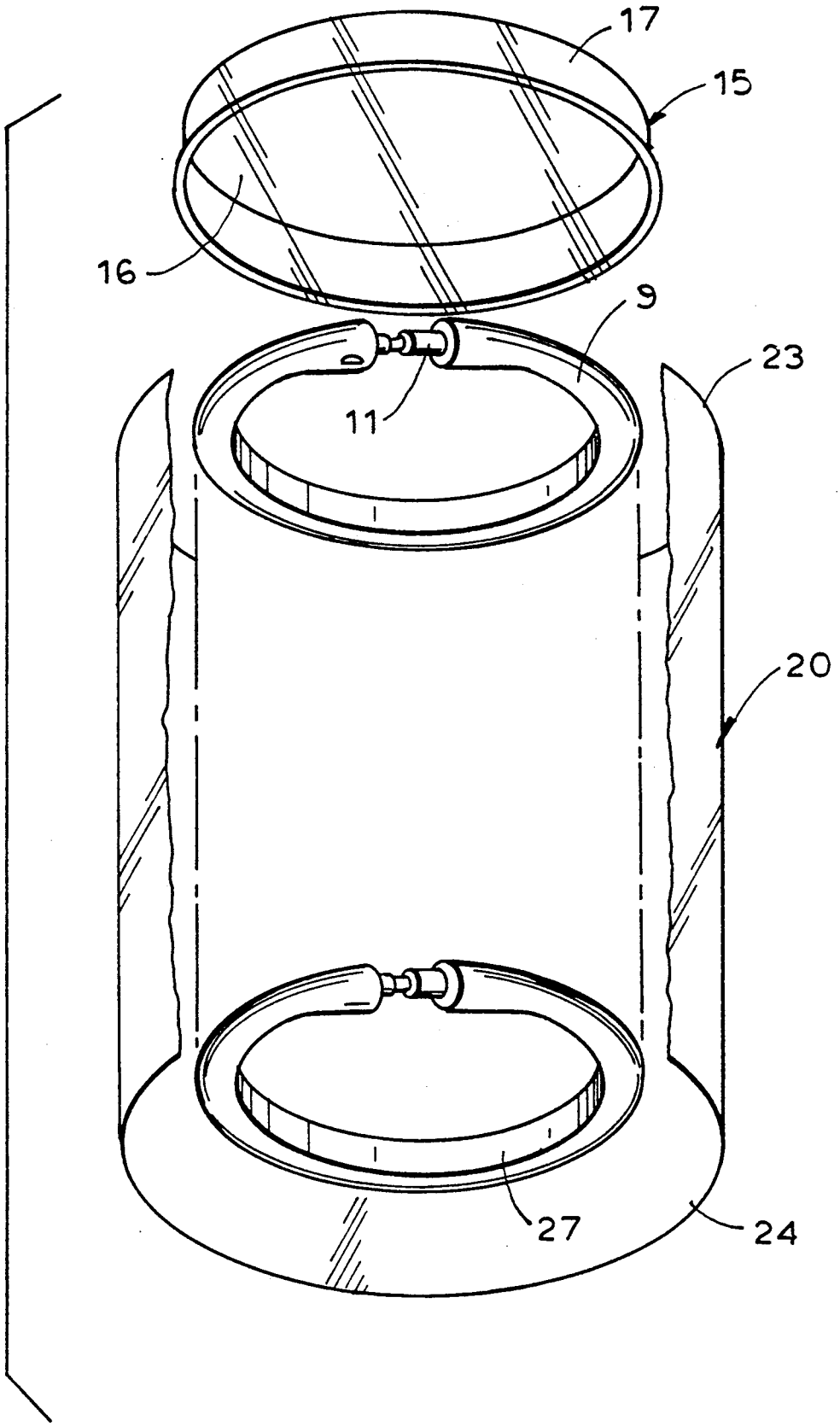
FIG. 5 is an exploded view of the new package with an optional bottom cap.

Referring now to FIGS. 1 and 3, the new invention in its simplest form is a package comprised of a dozen stacked shower curtain rings 9 which are of the type having a circular or annular body split at one side and having an integral pin 11 which may click-locked into a mating recess 12 formed opposite thereto. As shown in FIGS. 2 and 4, the groups of rings shown in FIG. 2 have a notched discontinuity 13 which is established by the geometry of the pin 11 and the opposed recess, giving the central opening 14 of the shower curtain ring a general "keyhole" configuration.

In accordance with the invention, a mandrel (not shown) is formed having cross-sectional configuration similar to that of the keyhole shape 14. The rings are then gathered and stacked on the mandrel in a manner such that they are aligned congruently as shown in FIG. 3 with all of the pins 11 parallel and aligned with one another. With the stack of rings 9 so aligned, a disk-shaped or cylindrical closure cap 15 having a circular top wall 16 and depending integral flanges 17 is placed over the stack of rings. The cap may be used to carry consumer information or uniform product codes. Thereafter, an elongated tube or sleeve of heat-shrinkable plastic film 20 such as heat-shrinkable PVC tube having an outer diameter slightly greater than that of the rings 9 is placed over the stack of aligned rings capped by the cylindrical end cap 15.

This assembly is subjected to elevated heat to tightly shrink the sleeve 20 as well as the end cap 15 over the stack of rings, resulting in the formation of the new and improved package 10 shown in FIGS. 1 and 3 in which the PVC sleeve 20 assumes a generally "corrugated" or sinuous appearance by virtue of its intimate and tight contact with the circumferential or equatorial portions of the stacked rings. The upper and lower PVC sleeve edges 23, 24 respectively, curl inwardly over the uppermost and lowermost rings to establish the package 10. The resulting package has a very unusual appearance which is both neat and attractive as well as providing visual access to all of the rings.

The new package 10 is highly distinctive and lends itself to facile stacking which may be enhanced in some instances when desired by the incorporation of a special alternate top cap 25. As shown in FIGS. 7 and 8, the top cap 25 is provided with a stepped projection 26 the outer diameter of which is adapted to fit snugly within the inner diameter 27 of the open bottom ring of a formed package. Thus the usage of the bottom connector caps 25 will permit the stacking of completed packages in the manner shown in FIG. 7.

It will be understood that other variations of top closures may be employed as found desirable or necessary for a particular application. However, the essence of the present invention is the production of an aesthetic assembly of aligned shower curtain rings closed at one end by a transparent cover and enveloped from top to bottom by a heat-shrunken sleeve maintaining the stack of rings in its attractive aligned assembly. The resultant transparent package provided the consumer with a total view of the entirety of the stack of rings. The method of establishing the new and improved package, employing a mandrel to align the rings and heat shrinking the rings while so aligned, lends itself to facile semiautomation or total automation using readily available conveyorization techniques, robotic techniques, and heat tunnel apparatus.

Although the foregoing description has been given by way of preferred embodiment related to aligned and specially configured shower curtain rings, it will be understood by those skilled in the art that other forms of the invention falling within the ambit of the following claims is contemplated. Accordingly, reference should be made to the following claims in determining the full scope of the invention.

What is claimed is:

1. A unitary totally transparent package of shower curtain rings comprising:

a. a stack of ring shaped articles, each of which articles has at least one predetermined discontinuity therein, said discontinuities being aligned one with the other in a manner whereby each of the articles in the stack is congruently aligned with the other;

b. a cylindrical transparent PVC cap element disposed tightly over an uppermost ring shaped article in intimate contact therewith;

c. an elongated tubular transparent polyvinyl chloride plastic sleeve enveloping the stack of ring shaped articles from top to bottom and being shrunken into intimate contact with the outer surfaces of each of said ring shaped articles and said cap element to provide a package having a corrugated appearance and providing visual access to the inner and outer portions of said entire stack of ring shaped articles.

2. The shower curtain ring package of claim 1, in which said top cap element includes a projection for resting in the bottom of a like package of ring shaped articles, and to enhance the ability of said packages to be stacked one on top of the other.

* * * * *